United States Patent [19]

Lennox, Jr. et al.

[11] Patent Number: 4,464,340

[45] Date of Patent: Aug. 7, 1984

[54] DISSOLUTION FLASK

[75] Inventors: John C. Lennox, Jr.; Warren A. McAllister, both of Greenville; Donald L. Mason, Washington, all of N.C.

[73] Assignee: Burroughs Wellcome Co., Triangle Park, N.C.

[21] Appl. No.: 273,317

[22] Filed: Jun. 15, 1981

[51] Int. Cl.[3] ..... B01L 11/02

[52] U.S. Cl. ..... 422/103; 422/225; 251/63

[58] Field of Search ..... 422/103, 99, 135, 224, 422/225, 261, 263, 269, 277, 282; 251/63, 25

[56] References Cited

U.S. PATENT DOCUMENTS

| | | | |
|---|---|---|---|
| 2,962,268 | 11/1960 | Soltermann | 422/99 |
| 3,159,378 | 12/1964 | Haag | 251/63 |
| 3,222,135 | 12/1965 | Ashmead | 422/103 |
| 3,567,390 | 3/1971 | Rothermel | 422/103 |
| 3,846,075 | 11/1974 | Cioffi | 422/103 |
| 4,158,694 | 6/1979 | Bischoff et al. | 422/103 |

FOREIGN PATENT DOCUMENTS

| | | | |
|---|---|---|---|
| 1933846 | 1/1970 | Fed. Rep. of Germany | 422/103 |

*Primary Examiner*—Hiram H. Bernstein
*Attorney, Agent, or Firm*—Robert T. Gammons

[57] ABSTRACT

A dissolution system for pharmaceutical solid oral dosage forms (medicinal tablets) comprising one or more open-top flasks for receiving a solvent media and the solid dosage forms to be tested, together with structure for delivering a solvent media into the flasks, structure for agitating the solvent media, structure for removing test samples, and structure in the form of a drain valve assembly at the bottom of each flask for removing residual solute and flushing the tank.

6 Claims, 5 Drawing Figures

DISSOLUTION FLASK

BACKGROUND OF INVENTION

Conventionally, dissolution tests for determining the rate of dissolution of pharmaceutical solid oral dosage forms (tablets) are carried out by pouring a predetermined quantity of a solvent media into a flask, dropping the tablet to be tested into the solution and agitating the tablet while in the media for a fixed interval of time. After dissolution, samples of the media are removed for testing and the flask is then emptied of the residual media and undissolved solute, and washed out with a suitable flushing medium. These manual operations are time-consuming, tedious and not particularly precise where large numbers of tablets are to be tested. It is the purpose of this invention to provide a system which is in large measure automated in that it enables carrying out testing operations without manually filling the flask with solvent, dropping the tablets thereinto and, after testing, removing the flask for cleaning. When this flask is integrated with media delivery, tablet delivery and sampling devices, the entire system will constitute an instrument for the fully-automated operation of sequential dissolution testing experiments.

SUMMARY OF INVENTION

As herein illustrated, the dissolution system according to this invention comprises in combination with one or more open-top flasks for receiving through their open tops a solvent and tablets to be dissolved therein, means at the top of each flask for withdrawing a sample of the solute and means at the bottom of each flask for drawing off the residual solute and for flushing the flask preparatory to the next dissolution test. There is also means supported above the open top of each flask for movement into the flask to effect agitating of the solvent media to augment dissolution of the tablet. The aforesaid means may comprise a vertically-positioned spindle mounted for vertical movement into the flask and for rotation while in the flask, to the lower end of which is fixed a paddle. Aternatively, a foraminous basket may be attached to the lower end of the spindle. There is means at the top of each receptacle in the form of a hose for delivering solvent media into the flask through the open top and also means at the top of each receptacle extending through the open top into the flask for withdrawing samples of the solute. The aforesaid means comprising the paddle or basket, the hose for delivering solvent media into the flask and the hose for removing solute from the flask are stationarily mounted on suitable supporting means above the open ends of the flasks. The means for removing the residual solute and for flushing is a drain valve assembly at the bottom of each flask comprising a valve body containing a valve chamber ported into the bottom of the flask, a piston valve in the valve chamber reciprocal therein, means for advancing and retracting the piston valve relative to the port to alternately close and open the port and means defining a discharge port from the chamber so positioned as to be closed when the piston is advanced and in communication with the port and the bottom of the flask when the piston is advanced and in communication with the port and the bottom of the flask when the piston is retracted. The flask has a hemispherical bottom wall containing a centrally-located port and the drain valve may either be attached thereto or formed integral therewith. If attached thereto, the body of the drain valve has a hemispherical end corresponding to that of the bottom of the flask and is attached thereto by a suitable adhesive or cement. The valve chamber contains a port at the end attached to the flask concentric with the port at the bottom of the flask, a discharge port at the same end and a fluid port at the other end. The piston valve is slidably mounted in the chamber, has at one end a valve element for interengagement with the ports at the other end of the chamber and at the bottom of the flask and is of such length that its distal end is flush with the inner side of the flask bottom when completely closed. There is a limit stop at the distal end of the chamber for limiting the retraction of the piston valve. A four-way valve is provided and there is means comprising a vacuum pump and positive pressure pump alternately connectable by way of the four-way valve to the fluid port to on the one hand retract the piston valve and on the other hand to advance the piston valve. The discharge port is so located that it is closed when the piston valve is in its advanced position and is open when the piston valve is in its retracted position.

The invention will now be described in greater detail with reference to the accompanying drawings, wherein.

The dissolution system herein illustrated is designed to enable carrying out tests on a number of tablets at the same time independently of each other and comprises in general a plurality of stationarily-supported, open-top flasks into which a predetermined quantity of solvent media can be introduced through the open tops, and into which the tablets to be tested may be introduced for agitation within the solvent media and from which a sample of the solute can be removed after a fixed interval of time through the open tops for testing and from which the residual solute and flushing liquid can be withdrawn from the bottom. The purpose is to determine that no less than a certain percentage is dissolved in that time.

Figure 1:
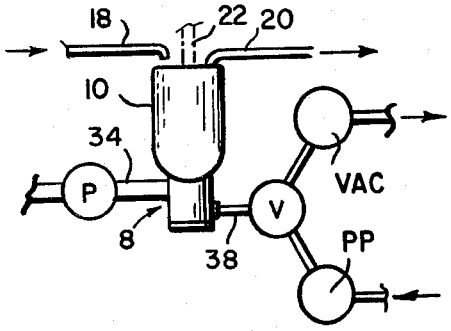
FIG. 1 is an elevation of a conventional dissolution flask provided with a drain valve assembly at the bottom in accordance with this invention.
Figure 2:
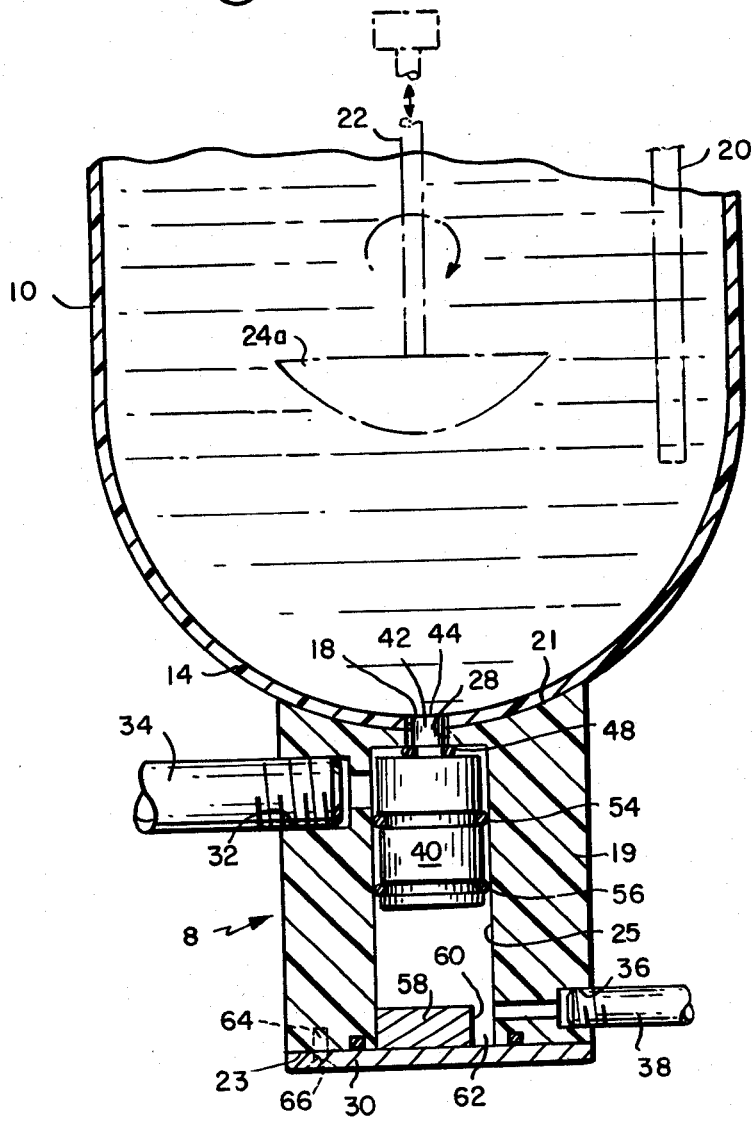
FIG. 2 is an enlarged fragmentary section of a dissolution flask showing a paddle within the flask and the drain valve assembly at the bottom in section as comprising a valve body and a piston valve reciprocal therein.
Figure 2A:
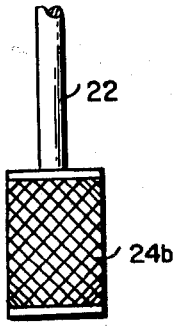
FIG. 2A is an elevation of a foraminous basket used in place of the paddle.

The structure of the system is shown in FIGS. 1 and 2 embodied in a single flask. It is to be understood, however, that several flasks are generally supported in a group on a supporting stand, together with the structure for introducing the solvent and the tablets and removing the samples and residual solute. Referring to FIGS. 1 and 2, each flask 10 is of circularly horizontal section and has an open top and hemispherical bottom 14. At the top of each flask, there is means in the form of a hose 18 or its equivalent for introducing solvent media into the flask and means in the form of a hose 20 which extends down into the flask for removing samples of the solute for testing. There is means at the top of each flask which can be lowered into the flask for agitating the tablets while in the solvent media comprising a spindle 22 to the lower end of which is fixed a paddle 24*a*. Alternatively, a foraminous basket 24*b* may be fixed to the lower end of the spindle for holding tablets suspended in the solvent media. The spindle is mounted for vertical reciprocation and for rotation.

Figure 3:
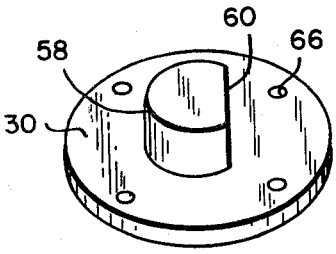
FIG. 3 is a perspective of the cover plate which is attached to the lower end of the valve body.
Figure 4:
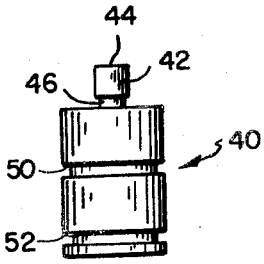
FIG. 4 is an elevation of the piston valve removed from the valve body.

In the system proposed, the flasks are supported in an upright position in a group with the hoses 18 and 20 and the spindle 22 permanently installed above the upper ends of the flasks so that the flasks cannot be individually removed nor can the apparatus as a whole be tipped upside down for the purpose of removing the residual solute after testing and for the further purpose of washing and flushing out the flasks preparatory to the next test. It is the purpose of this invention to provide for removing the residual solute and flushing of the flask through the bottom without having to disturb the structure as a whole and this is accomplished by providing at the bottom of each flask a bottom drain valve assembly 8 for maintaining the solvent media in the flask during dissolution and to enable withdrawing the residual solute and/or flushing fluid from the bottom of the flask. Referring specifically to FIGS. 2, 3 and 4, the drain valve assembly 8 as herein illustrated comprises a rigid valve body 19 of circular cross section which has at one end a hemispherical convex end surface 21 corresponding in curvature to the hemispherical convex bottom 14 of the flask and at the other end a flat end surface 23. The valve body contains a valve chamber 25 which extends from the flat end surface partway through, terminating short of the spherically-concave end surface 21. As illustrated, the spherically-concave end surface 21 of the valve body is attached to the spherically-convex end surface 14 of the flask, for example, by means of cement or by fusing. At the closed end of the valve chamber, there is a port 28 concentric with the port 18 at the bottom of the flask. The open end of the valve chamber 25 is closed by a cover plate 30. Near the closed end of the valve chamber in the side wall thereof, there is a threaded discharge port 32 for receiving a threaded coupling 34, for example, at the end of a flexible conductor hose leading to the intake side of the discharge pump P, FIG. 1. Near the open end of the chamber, there is a threaded port 36 for receiving a threaded coupling 38, for example, at the end of a flexible conductor hose or pipe leading to a four-way valve V, FIG. 1, which, in turn, is connected by way of suitable conductors to a vacuum pump VAC and a pressure pump PP. Within the valve chamber 25, there is a piston valve 40 of a cross section corresponding to that of the valve chamber, at one end of which there is a valve element 42 of a cross section to slidingly engage within the ports 28 and 18 of a length such that the end extremity 44 of the valve element 42 is flush with the interior bottom surface of the flask. At the junction of the valve element 42 with the piston valve, there is a groove 46 within which is seated a ring 48. The piston valve contains two axially-spaced grooves 50,52, the groove 50 being located between its ends and the groove 52 being located at the end opposite the valve element within which are seated rings 54 and 56. The piston valve 40 is axially shorter than the valve chamber 26 and sufficiently so that it can be moved from an advanced position in which the valve element 42 is engaged with the ports 28 and 18 and in which it covers the discharge port 32 to a retracted position in which the valve element is disengaged from the ports and the discharge port uncovered. In the one position, the valve element 42 seals the port 18 at the bottom of the flask. This is the position it occupies during tablet dissolution. In the other position, it permits the solution to be withdrawn through the ports 18 and 28 into the valve chamber 25 and from thence through the port 32 for discharge.

Reciprocal movement of the piston valve 40 is effected by applying a positive pressure by means of the positive pressure pump PP through the four-way valve V to the lower end of the valve chamber 25 to force the piston valve 40 upwardly and by applying a negative pressure by means of the vacuum pump through the four-way valve to the lower end of the valve chamber to pull the piston valve downwardly. In order to limit the retraction of the piston valve, the cover plate 30 is provided with a protrusion 58 which prevents the lower end of the piston from covering the port 36. The protrusion 58 has a flat side 60 opposite the part 36 so that when the piston is pulled down into engagement therewith, there will be a gap 62 through which pressure can be introduced to the lower end of the chamber below the piston. In order to insure properly replacing the cover plate 30 with the flat side 60 opposite the port 36, the lower end of the valve body and the closure plate are provided with eccentrically threaded holes 64,66 for receiving fastening screws so that the cover plate 30 can be placed in but one position in relation to the port 32.

The continuity of the inside surface of the flask is of major importance as any variation therein can materially affect the results of the tests carried out. Hence, the port 18 is made as small as possible so as not to interrupt the surface appreciably and desirably is in the order of 0.2500 inches in diameter. The upper end 44 of the piston valve is made uniformly flat to be substantially flush with the inside bottom contour of the flask.

The flask may be Acrolyte or glass, the valve housing and cover plate Nylon and the piston valve Teflon.

It is within the scope of the invention to mount a group of six or more flasks on a common stand for performing dissolution tests on a corresponding number of tablets at one time and to connect the drain valves at the bottom of these flasks by way of flexible conductors to a common positive pressure and vacuum pump so that all of the flasks can be emptied and flushed at one time.

Although the flask and valve body are herein illustrated as separate parts, it is within the scope of the invention to form the flask and drain valve body integral and to attach the cover plate to the valve body. Likewise, although the protrusion 58 is shown attached to the cover plate, it may be formed integral therewith. The flask and drive valve assembly may be molded or drawn or otherwise formed of any suitable synthetic material which is compatible with the process for which the structure is to be used or may be fabricated of metal.

Dissolution apparatus having a plurality of flasks of the kind herein shown and described, but without bottom drain valves, are available from Manson Research Corp., 19727 Bahama Street, Northridge, CA; Ace Glass Inc., P. O. Box 688, 1430 North West Boulevard, Vineland, NJ; and Van Kel Industries, P. O. box 311, Chatham, NJ 07928.

It should be understood that the present disclosure is for the purpose of illustration only and includes all modifications or improvements which fall within the scope of the appended claims.

What is claimed is:

1. A system for dissolution of solid forms of matter to determine their solubility in a solvent media, comprising a flask having an open top through which media can be introduced into the flask and through which solid forms of matter to be treated can be deposited into the solid media and a hemispherical bottom containing a bottom opening concentric with the vertical axis of the flask through which residual solute can be withdrawn and means for controlling withdrawal of the residual solute from the bottom of the flask through said bottom opening comprising a valve body secured to the bottom of the flask over the bottom opening defining an elongate valve chamber, the axis of which coincides with the vertical axis of the flask and is centered with respect to the center of the bottom opening, a piston valve reciprocally mounted in the valve chamber, a valve element at one end of the piston valve corresponding in cross section to the bottom opening, said piston valve being movable in the chamber to on the one hand project the valve element into the bottom opening to close the same and on the other hand to withdraw the valve element from the bottom opening to permit flow through the bottom opening into the valve chamber, a discharge port in the valve body adjacent the upper end in a position to be covered by the piston valve when the valve element occupies the bottom opening and to be uncovered by retraction of the piston valve, a discharge pump connected to the discharge port, a control port at the lower end of the chamber, a selector valve connected to the control port, and a vacuum pump and a pressure pump connected to the selector valve operable by movement of the selector valve alternately to connect the vacuum pump and the pressure pump to the chamber to effect reciprocation of the piston valve.

2. A system according to claim 1 wherein the bottom of the flask at the inside is spherically concave and the free end of the valve element is provided with a concave surface corresponding in radius of spherical concavity to the bottom of the flask such that when the valve element is projected into the bottom opening, the free end of the valve element coincides with the spherical concavity of the inside surface at the bottom of the flask.

3. A system according to claim 1 wherein there is a stop at the bottom of the chamber for limiting retraction of the piston valve to a positon above the level of the control port at the bottom of the chamber.

4. A system according to claim 25 wherein there is a sealing ring positioned about the piston valve element for sealing the bottom opening when the valve element is engaged within the bottom opening.

5. A system according to claim 1 wherein the piston valve has axially-spaced sealing rings which seal the chamber at one end of the piston valve from that at the other end.

6. A system according to claim 1 wherein there is an agitator supported above the flask for movement into and out of the flask through the top opening for rotational movement within the flask to agitate the solvent media therein and means at the top of the flask for drawing a sample of the solute from the flask through the open top.

* * * * *